US007876338B2

(12) United States Patent
Jeong

(10) Patent No.: US 7,876,338 B2
(45) Date of Patent: Jan. 25, 2011

(54) PLASMA DISPLAY PANEL DRIVING METHOD AND APPARATUS

(75) Inventor: Jae-Seok Jeong, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 1297 days.

(21) Appl. No.: 11/131,294

(22) Filed: May 18, 2005

(65) Prior Publication Data

US 2005/0264483 A1 Dec. 1, 2005

(30) Foreign Application Priority Data

May 28, 2004 (KR) ..... 10-2004-0038274

(51) Int. Cl.
*G09G 3/28* (2006.01)
*G09G 5/10* (2006.01)

(52) U.S. Cl. ..... 345/691; 345/60

(58) Field of Classification Search ..... 345/60–72, 345/204, 690–693
See application file for complete search history.

(56) References Cited

U.S. PATENT DOCUMENTS

| | | | | |
|---|---|---|---|---|
| 6,317,104 | B1 | 11/2001 | Kasahara et al. | 345/63 |
| 7,102,595 | B2 * | 9/2006 | Park | 345/60 |
| 7,227,581 | B2 * | 6/2007 | Correa et al. | 348/447 |
| 2002/0030643 | A1 * | 3/2002 | Sasaki et al. | 345/60 |
| 2002/0097202 | A1 | 7/2002 | Park | |
| 2002/0140636 | A1 * | 10/2002 | Holtslag et al. | 345/55 |

FOREIGN PATENT DOCUMENTS

| | | |
|---|---|---|
| CN | 1234577 | 11/1999 |
| JP | 10-207426 | 8/1998 |
| JP | 11052912 | 2/1999 |
| JP | 2000-066638 | 3/2000 |
| JP | 2001-125536 | 5/2001 |
| JP | 2002-221934 | 8/2002 |
| JP | 2002-354378 | 12/2002 |
| KR | 10-2000-0070527 | 11/2000 |
| KR | 1020010009955 | 2/2001 |
| WO | 01-29812 | 4/2001 |

* cited by examiner

*Primary Examiner*—Alexander S. Beck
(74) *Attorney, Agent, or Firm*—H.C. Park & Associates, PLC

(57) ABSTRACT

The present invention relates to a plasma display panel driving method and apparatus for reducing subfield position variation between display frames by arranging an idle period among the subfields. The subfields included in the frame may be divided into at least two subfield groups with reference to a predetermined weight value at which flicker may occur. An idle period, which is substantially a residual time of the frame excluding the subfields, may be arranged between two divided subfield groups. Accordingly, flicker caused by the variation of the number of subfields between frames can be prevented because of the reduced positional variation of the subfields.

22 Claims, 5 Drawing Sheets

PLASMA DISPLAY PANEL DRIVING METHOD AND APPARATUS

CROSS-REFERENCE TO RELATED APPLICATION

This application claims priority to and the benefit of Korean Patent Application No. 10-2004-0038274, filed on May 28, 2004, the entirety of which is hereby incorporated by reference.

BACKGROUND OF THE INVENTION

1. Field of the Invention

The present invention relates to a plasma display panel (PDP) driving method and apparatus, and, in particular, a PDP driving method and apparatus that prevents subfield position variation by arranging an idle period among groups of subfields in a frame.

2. Description of the Related Art

Generally, a PDP is driven by frames that are divided into subfields. These subfields may include a sustain period having a respective weight value, and the PDP displays gray-scale data as brightness according to the combination of the weight values of each subfield. When the number of subfields included in a given frame is increased, the brightness generated by each subfield may be reduced, which allows improved control of gray-scale data display. In addition, false contours may be prevented because the brightness difference among subfields is reduced.

However, for use as a television (TV), it is preferable that a PDP provide sufficient luminescence. A typical light emitting efficiency of a PDP is of about 1-3 lm/W.

The brightness of the PDP is principally dependent on the number of sustain pulses used to provide a sustain discharge during a frame. Generally, in order to achieve sufficient brightness, 1,400 to 3,000 sustain pulses are used each frame to acquire a peak luminescence of 650-1,500 cd/m$^2$. As a result, a sufficient number of subfields may not be used for expressing gray-scale data. A typical number of subfields used in a PDP TV is about 10 to 16 subfields.

Referring to FIG. 1, in a 6-bit gray-scale data display scheme, one TV frame is divided into 6 subfields SF1-SF6. Each subfield may be divided into an address period A1-A6 and a sustain period S1-S6. An idle period R is placed at an end of the frame, in which no discharge occurs. The idle period R is given as a residual time of the frame excluding the time for the subfields.

The subfields will be now described in reference to an image standard of the National Television System Committee (NTSC).

According to the NTSC standard, 60 frames are included in one second and, thus, 16.67 ms may be used for realizing a respective frame.

As noted above, 10-16 subfields are included in a TV frame, and each subfield may include a reset period, an address period, and a sustain period. The reset period is about 200 μs, and the address period can be determined by multiplying the number of scan lines by a scan pulse width. For example, in an standard definition PDP, in which the number of scan lines is 480 and the scan pulse width is 1.7 μs, the address period is 816 μs (480 lines×1.7 μs). Since sustain periods have different weight values, there may be a different number of sustain pulses throughout the subfields' sustain periods. One sustain pulse period usually takes about 5 μs. The reset period and the address period, however, are typically uniform throughout the subfields.

A typical maximum brightness of a PDP TV is about 1000 cd/m2. Therefore, in order to realize higher brightness levels, the efficiency of the PDP or the number of sustain pulses must be increased. However, since a significant number of the sustain pulses are already being used, their number may not be easily increased.

Recent PDP TV's mostly use 10-12 subfields per TV frame, although the number of subfields could be increased in a more efficient PDP. A variable subfield scheme that varies the number of subfields according to an average signal level (ASL) of an image is now being used to efficiently control the number of subfields according to brightness. The ASL, which is an average signal level of an image data histogram or a load ratio, can be given by the following Equation 1.

$$ASL = \left(\sum_V RDATA_n + \sum_V GDATA_n + \sum_V BDATA_n\right) \Big/ 3N \qquad \text{(Equation 1)}$$

Here, V indicates one frame.

Because high power consumption is a PDP driving variable, an automatic power control (APC) scheme may also be used to control power consumption based on the ASL (or the load ratio) of a frame to be displayed. According to the APC scheme, power consumption is kept below a predetermined level by varying an APC level in accordance with a load ratio of input image data, and by varying the number of sustain pulses in accordance with the APC level.

As shown in FIG. 2, the APC is shown to include only three stages for demonstrative purposes. However, an APC may be realized with a much greater number of stages, such as 128 or 256 stages, for example.

APC stage 0 is utilized when an image of a low ASL is input from the outside, i.e., the input image is dark or requires only a small screen area to display. The number of sustain pulses provided is relatively large because little power is consumed. In contrast, APC stage 2 is utilized when the image is bright or requires a large screen display area. Accordingly, the power consumption is high and the number of sustain pulses provided is decreased to limit power consumption. Therefore, an idle period is enlarged in APC stage 2, because the time for the subfields in a frame is relatively shorter than those of APC 0 or APC 1.

False contours, however, may result due to the variances in idle periods between TV frames using different APC stages. Therefore, in order to reduce these false contours, such an APC scheme may be combined with a variable subfield scheme.

A conventional variable subfield scheme may be found in Korean Patent Publication No. 10-2000-0070527. This reference discloses that gray-scale data is displayed by selecting 11 or 12 subfields depending on the APC level, which in turn depends on an ASL or a load ratio of displayed image. When displaying a dark image of a low APC level, the gray-scale data is usually displayed with 11 subfields for maximum brightness.

When displaying a bright image of a high APC level, sustain discharges are generated in a large number of discharge cells of a PDP, which increases the power consumption of the PDP. Therefore, the number of sustain discharges needs to be limited in order to maintain the power consumption at a predetermined level. Moreover, the false contours occur more often in the case of displaying a bright image rather than a dark image. Accordingly, the gray-scale data is displayed using an increased number of subfields (i.e., 12 subfields), which reduces the number of sustain discharges in the subfield, in part, because of the increased time taken by the additional reset and address periods. According to the conventional art, when the number of subfields is changed according to the variable subfield scheme, a center of the subfield of an uppermost weight value is changed and an abnormal variation is caused in image brightness. In order to prevent such a phenomenon, the idle period is placed foremost in the frame.

The abnormal image brightness variation and flicker may be prevented to some degree by placing the idle period foremost in the frame. However, the weight value allocated to each subfield is greater in a frame having a lesser number of subfields than a frame having a greater number of subfields. Therefore, the light emitting time of the rest of the subfields is changed even if a finishing point of the subfield having a maximum weight value is the same. As a result, flicker still occurs when the number of subfields in a frame is changed.

SUMMARY OF THE INVENTION

The invention discloses a PDP driving method including generating a plurality of subfields based on an input video signal, the plurality of subfields are included in a frame; displaying gray-scale data according to a combination of weight values assigned to the subfields; and changing the number of subfields included in the frame based on a load ratio corresponding to the input video signal, wherein the subfields used for displaying the frame are divided into at least two subfields groups based on a predetermined weight value, and wherein an idle period is placed between two divided subfield groups, the entire idle period being substantially a residual period of the frame excluded from the subfields.

In another embodiment of a PDP driving method, the idle period is either placed between two divided subfield groups, or the idle period is divided into at least first and second idle periods such that the first idle period is placed at a starting point of the frame and the second idle period is placed between two divided subfield groups.

The invention also discloses a PDP driving apparatus used in a PDP displaying gray-scale data according to a combination of weight values assigned to subfields in a frame. The PDP driving apparatus includes an APC unit detecting a load ratio of an input video signal and outputting an APC level for controlling power consumption based on the detected load ratio; and a sustain/scan driving controller calculating APC data including a number of subfields to be included in the frame corresponding to the APC level, a starting point and duration of each subfield, and a number of sustain pulses, and generating a subfield arrangement structure according to the APC data, wherein the subfields are divided into at least two groups based on a predetermined weight value, and wherein the idle period is placed between two subfield groups.

In another embodiment of a PDP, the idle period is either placed between two divided subfield groups, or the idle period is divided into at least first and second idle periods such that the first idle period is placed at a starting point of the frame and the second idle period is placed between two divided subfield groups.

DETAILED DESCRIPTION OF THE EMBODIMENTS

In the following detailed description, embodiments of the present invention are shown and described, by way of illustration. As those skilled in the art would recognize, the described embodiments may be modified in various ways, all without departing from the spirit or scope of the present invention. Accordingly, the drawings and accompanying description are meant to be illustrative, rather than restrictive, in nature.

Figure 1:
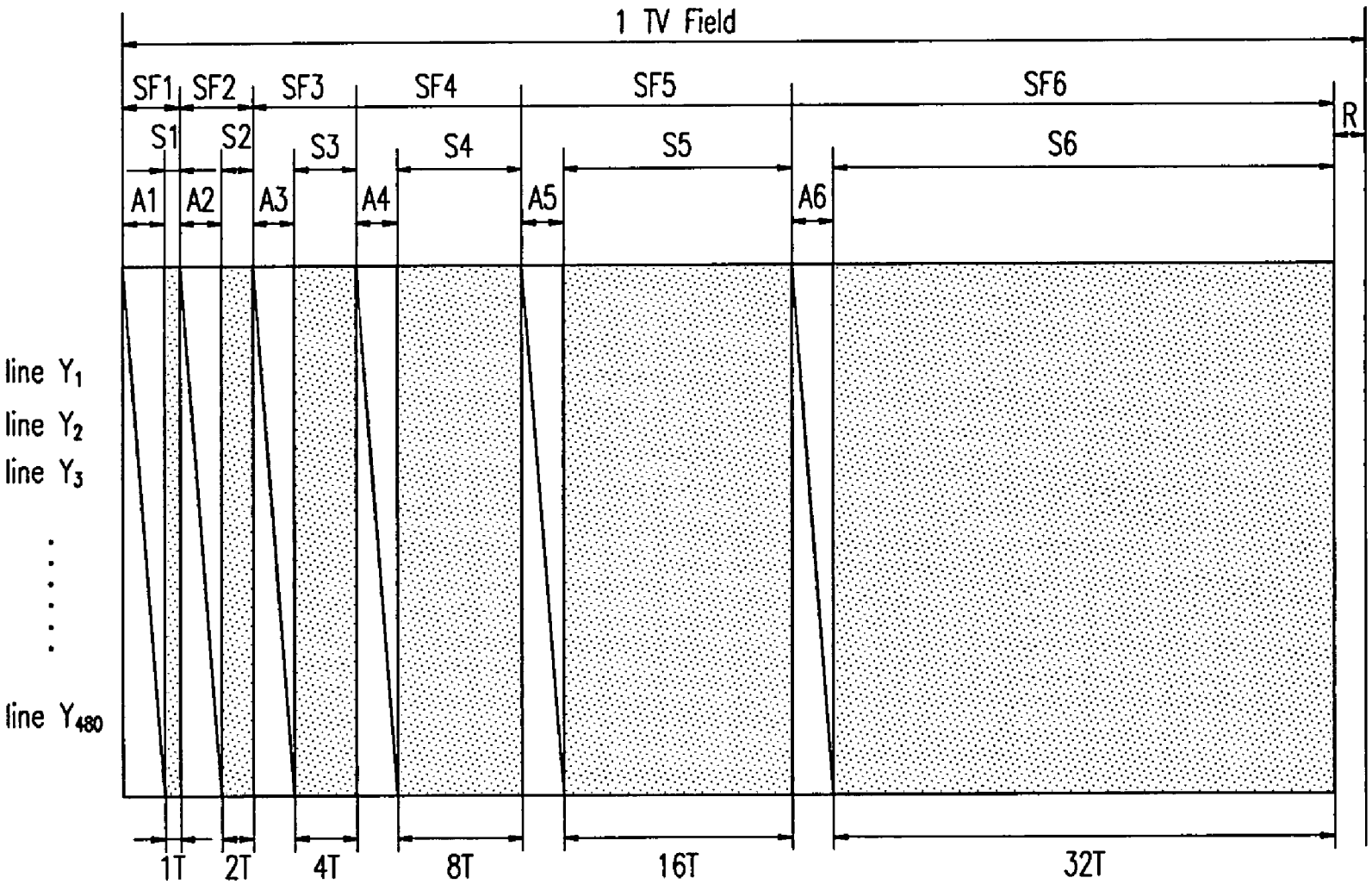
FIG. 1 shows a subfield structure in a general PDP driving scheme.
Figure 2:
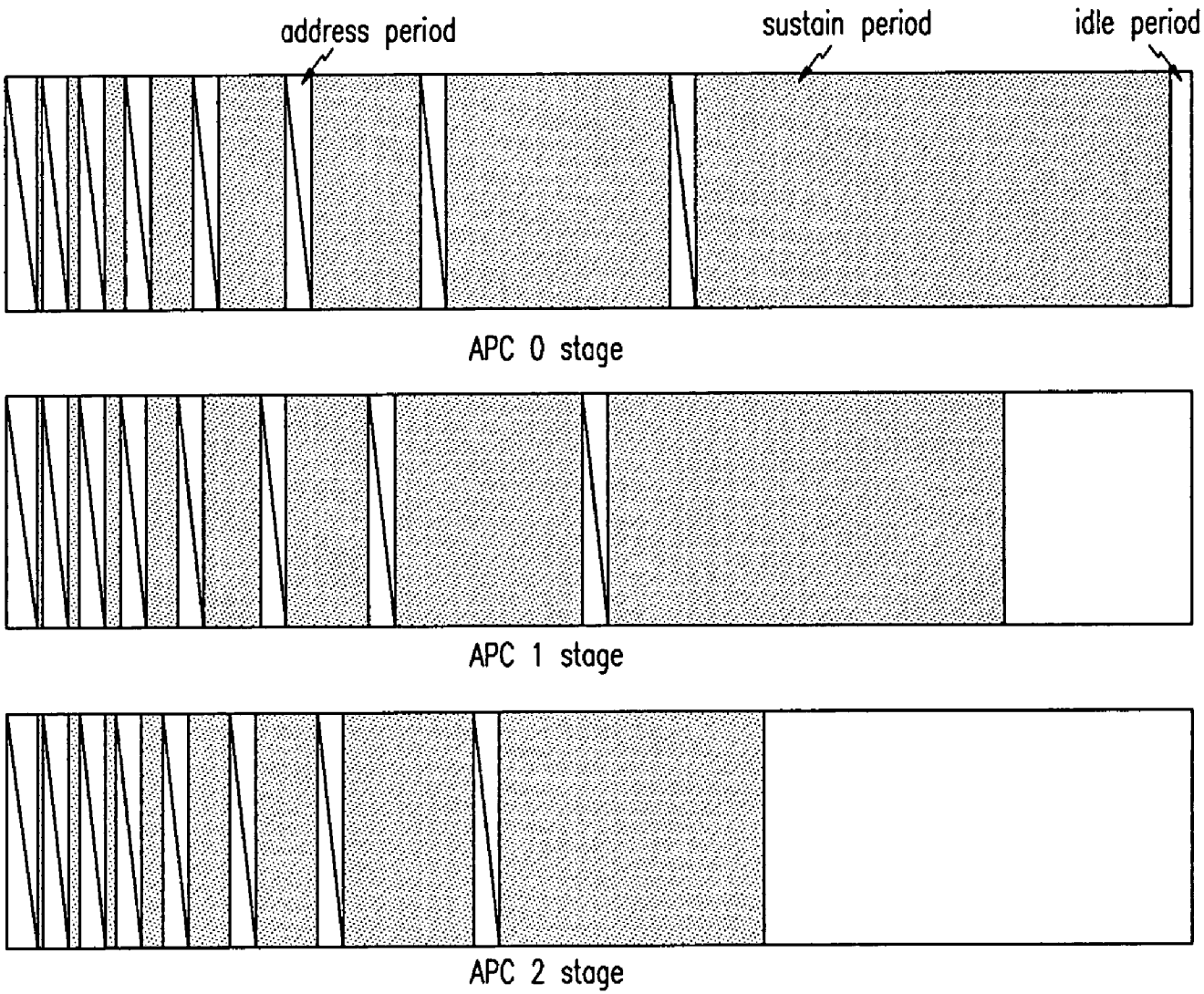
FIG. 2 shows a PDP gray-scale data display method in a PDP using APC.
Figure 3:
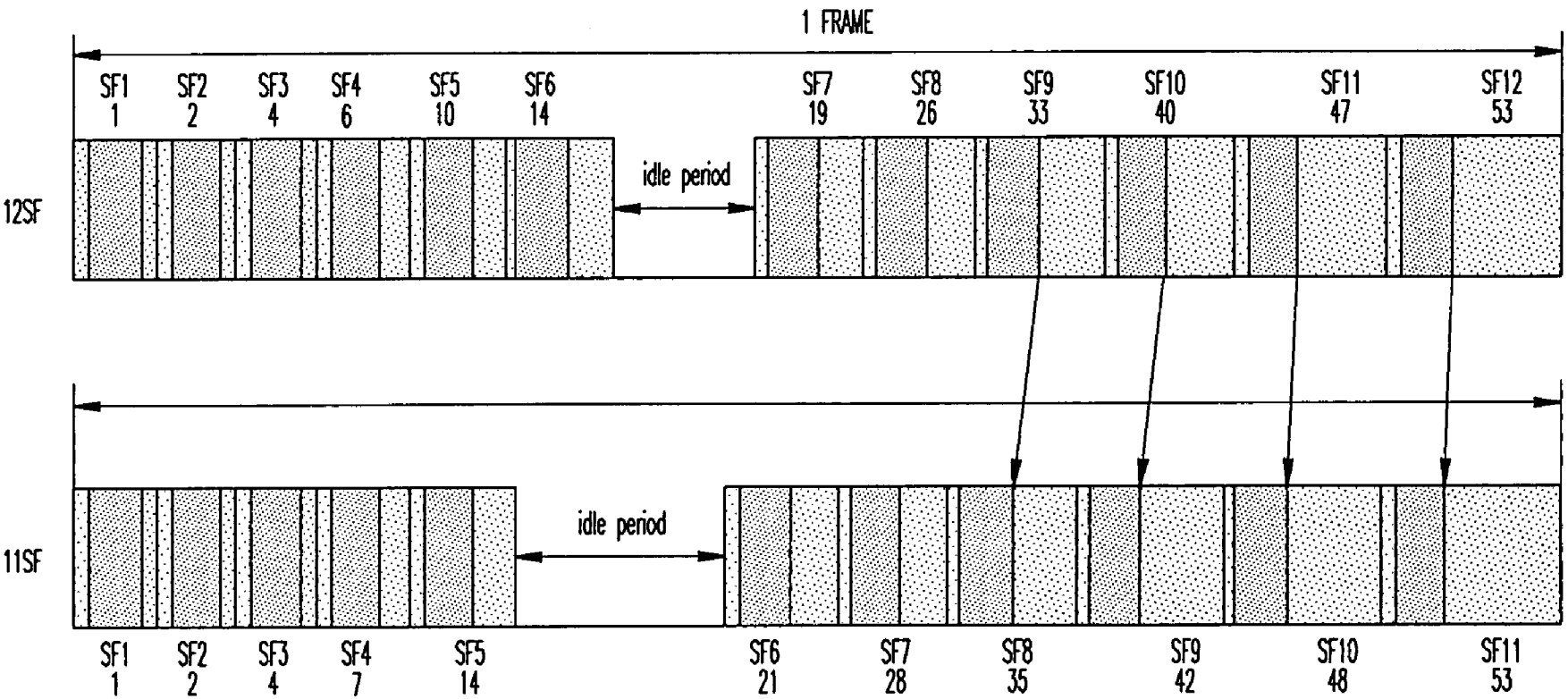
FIG. 3 shows a subfield arrangement in frames from a PDP driving method according to an embodiment of the present invention.

Looking at FIG. 3, in a PDP driving method according to an embodiment of the present invention, a frame includes subfields divided into two groups by an idle period. The subfields are divided into the two groups with reference to their weight values. When a weight value of a subfield is less than a predetermined weight value, such a subfield may be included in a first subfield group at the front of a frame. When a weight value of a subfield is greater than the predetermined weight value, such a subfield may be included in a second subfield group at the rear of the frame. The subfield having the same weight value as the predetermined weight value may be included in either subfield group.

The number of subfields used for displaying gray-scale data may be changed with reference to a predetermined ASL, or screen load ratio. Flicker, caused by a change in the number of subfields, can be minimized by placing the idle period between the divided subfield groups because the positional variation of the subfields between frames is reduced.

The subfields to be arranged in the two divided subfield groups may be arranged in increasing or decreasing order of weight value.

The predetermined weight value is the subfield weight value that may cause flicker when the number of subfields is changed. This predetermined weight value may be acquired statistically or experimentally. Here, the predetermined weight value is assumed to be 7% of the sum of the subfields' weight values over an entire frame. Thus, the predetermined weight value is 18 when the sum of the weight values is 255 (7%=17.85), 36 when the sum of the weight values is 511 (7%=35.77), and 72 when the sum of the weight values is 1023 (7%=71.61). It is obvious to a person of an ordinary skill in the art that this predetermined weight value may vary depending on the PDP design type.

In the frame illustrated in FIG. 3, the sum of the weight values is 255. Accordingly, the subfields are divided into a first subfield group and a second subfield group, according to the predetermined weight value of 18, with an idle period placed between the groups. For example, in a frame including 12 subfields, subfields SF1 to SF6 are included in the first subfield group and subfields SF7 to SF12 are included in the second subfield group. The idle period is placed between subfield SF6 and subfield SF7. When the number of subfields is 11, subfields SF1 to SF5 are included in the first subfield group and subfields SF6 to SF11 are included in the second subfield group. The idle period is placed between subfield SF5 and subfield SF6.

Thus, the light emitting position variation of the two subfield groups can be minimized, since the idle period is placed between the two divided subfield groups and the position variation of the first subfield group between the two frames becomes smaller than previously.

Figure 4:
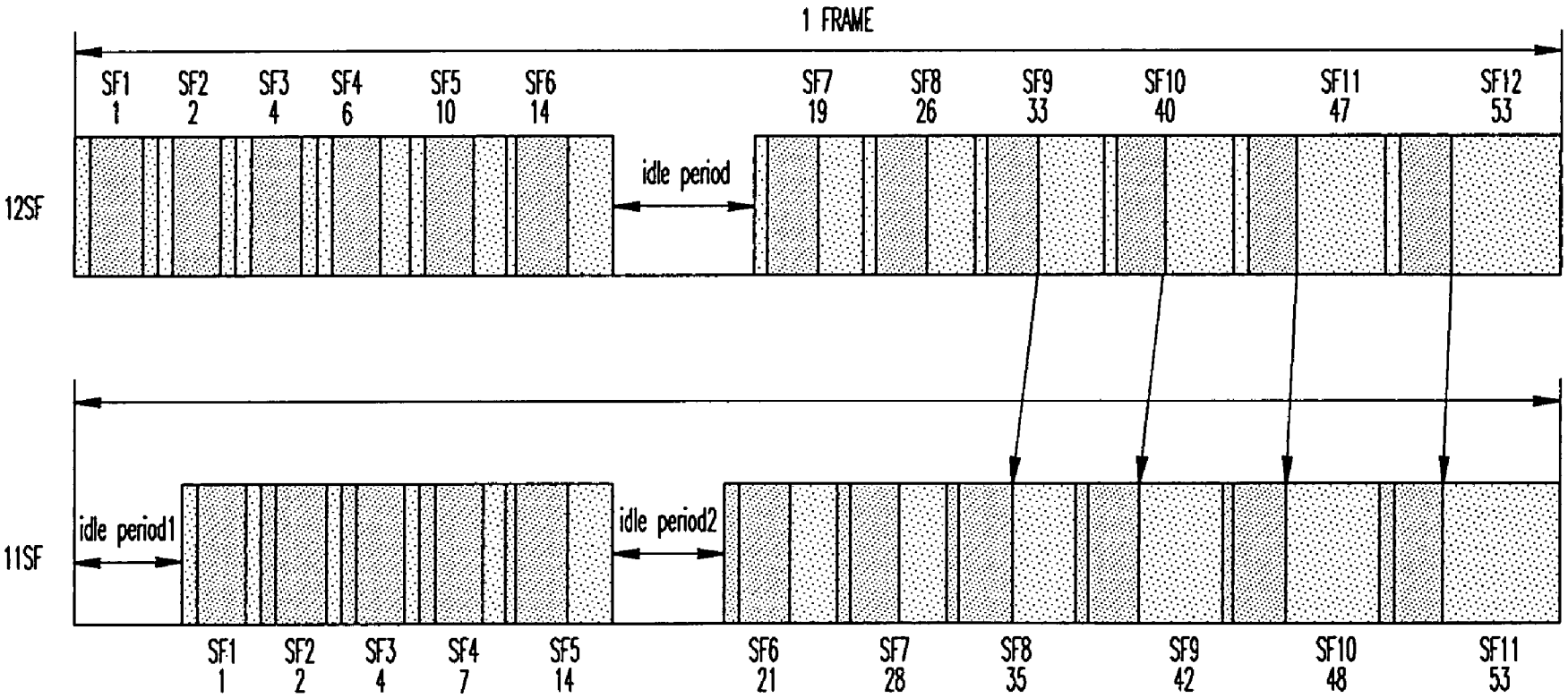
FIG. 4 shows a subfield arrangement in frames from a PDP driving method according to another embodiment of the present invention.

As shown in FIG. 4, in a PDP driving method according to another embodiment of the present invention, the arrangement of the idle period can be varied in accordance with the number of subfields. More particularly, an idle period may either be placed between the two subfield groups or may be divided and placed in front of each of the first and second subfield groups. The idle period may be placed between the two subfield groups when the number of subfields is greater than a predetermined number of subfields in a frame. When the number of subfields is less than this predetermined number, the idle period may be divided into two parts, one of which may be placed between the two subfield groups and the other may be placed at the starting point of the frame, in front of the first subfield group.

As before, the subfields are divided into the two subfield groups with reference to the predetermined weight value (i.e., 7% of the sum of all subfield weight values) regardless of the number of subfields. When the number of subfields is 12, the idle period is placed between the first and second subfield groups. When the number of subfields is 11, however, the idle period is divided into two parts, wherein one part is placed between the subfield groups and the other part is placed at the starting point of the frame. Because the idle period is longer when there is a smaller number of subfields in a frame, this longer idle period can be divided.

In the case where the idle period is divided, the idle period placed in front of the first subfield group may be approximately the same length as the first subfield SF1 (e.g., about 1 ms). In this manner, even if the number of subfields is changed from 12 to 11, a movement of the first subfield group can be prevented by as much as the length of the first subfield SF1 (1 ms), and the flicker caused by the light emitting position variation of the subfield group of relatively less brightness can be reduced.

Moreover, the idle period placed in front of the first subfield group may be set as a value that enables the finishing point of the last subfield of the first subfield group to be the same as when the frame includes 12 subfields. In such a case, the position shift of the subfield that is more likely to cause flicker, because of its higher weight value, may be prevented.

Figure 5:
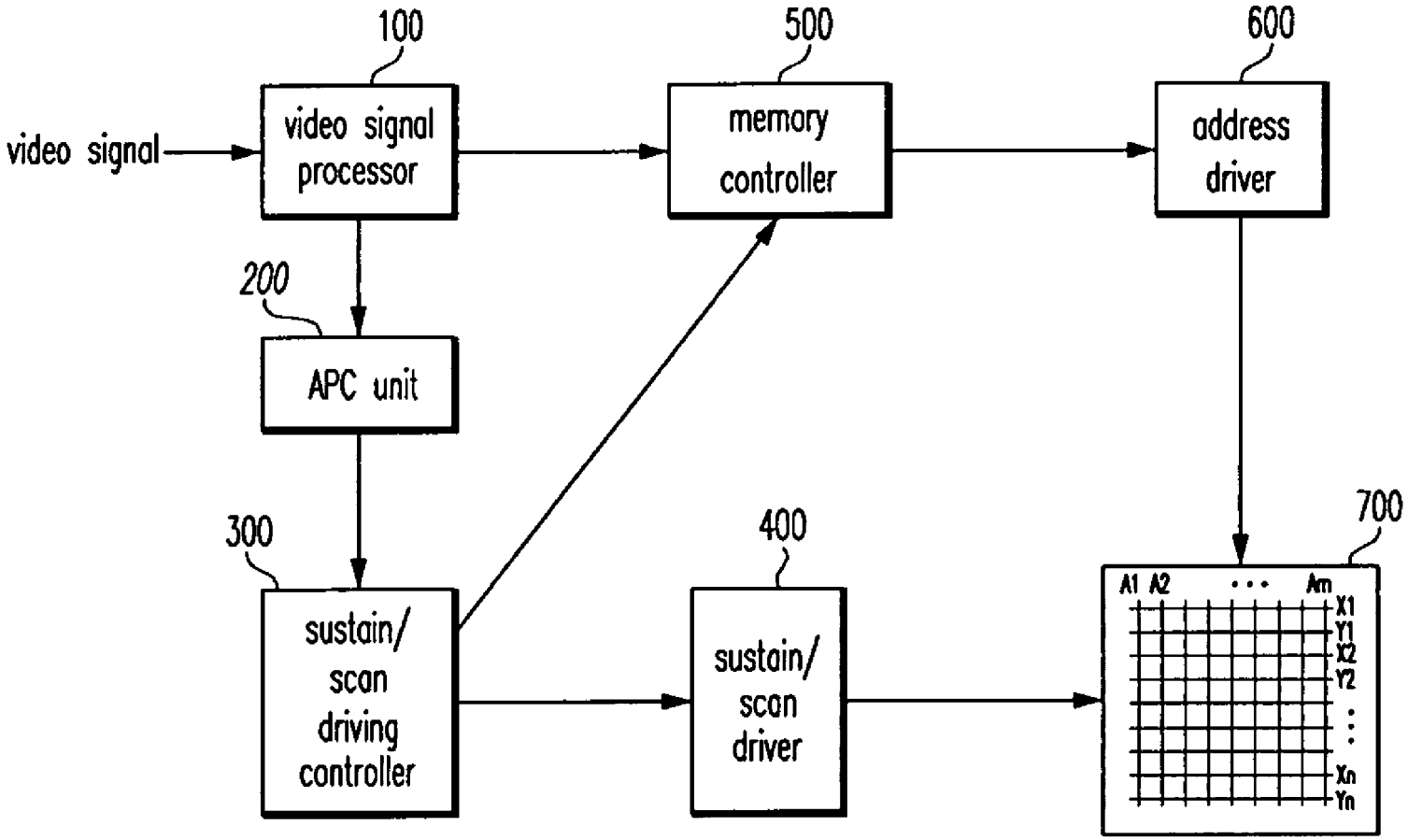
FIG. 5 shows a block diagram of a PDP driving apparatus according to an embodiment of the present invention.

Now looking at FIG. 5, a PDP driving apparatus according to an embodiment of the present invention includes a video signal processor 100, an APC unit 200, a sustain/scan driving controller 300, a sustain/scan driver 400, a memory controller 500, and an address driver 600.

Video signal processor 100 converts an input video signal into digital image data.

APC unit 200 detects an ASL by using image data output from video signal processor 100 and outputs an APC level from the detected ASL.

Sustain/scan driving controller 300 calculates APC data including the number of subfields corresponding to the APC level output by the APC unit 200, the starting point and duration of each subfield, and the number of sustain pulses. Sustain/scan driving controller 300 then generates and outputs a corresponding subfield arrangement structure. Based on the number of subfields and the starting point and duration of each subfield, sustain/scan driving controller 300 calculates an idle period and then generates a subfield arrangement structure in which the calculated idle period is placed between the subfield groups or is divided in two parts, one of which is placed in front of the first subfield group as described above.

The idle period of each frame can be calculated by subtracting the time for all the subfields from the total frame time.

Sustain/scan driving controller 300 divides the subfields into two groups, i.e., into first and second subfield groups that are respectively positioned forward and rearward in the frame, based on the predetermined weight value (e.g., 7% of the sum of the weight values of all the subfields).

Sustain/scan driving controller 300 may place the idle period between the first and second subfield groups.

Alternatively, the sustain/scan driving controller 300 may divide the idle period into two idle periods when a frame has a longer idle period due to fewer subfields. In that case, sustain/scan driving controller 300 places one idle period between the frame starting point and the first subfield group, and places the other idle period between the first and second subfield groups.

Sustain/scan driver 400 generates a sustain pulse and a scan pulse based on the subfield arrangement structure output from sustain/scan driving controller 300, and then applies the sustain pulse and the scan pulse to scan electrodes $X_1$-$X_n$ and sustain electrodes $Y_1$-$Y_n$ of PDP 700.

Memory controller 500 receives digital image data output from video signal processor 100 and the number of subfields calculated by sustain/scan driving controller 300, and generates corresponding subfield data.

Address driver 600 generates address data corresponding to the subfield data output from memory controller 500, and applies the address data to address electrodes $A_1$-$A_m$ of PDP 700.

In the above description, regarding the second subfield group, which includes the subfields having greater weight values than the predetermined weight value, a finishing point of the subfield having the maximum weight value has been described to be the same as the finishing point of the frame. However, the scope of the present invention is not limited thereto, since the subfield having the maximum weight value in the second subfield group may also be finished by a predetermined term (e.g., 0 μs to 500 μs) before the finishing point of the frame.

In addition, it is described that the subfields for displaying the frame are divided into two subfield groups based on the predetermined weight value, and the idle period is placed between the groups or is divided and one part is placed in front of the first subfield group. However, the scope of the present invention should not be understood to be limited thereto. As a variation, whole subfields may be divided into more than two subfield groups based on a plurality of predetermined weight values, and the idle period of each frame may also be divided such that each divided idle period is placed between adjacent subfield groups. Alternatively, the idle period may be divided into the same number as the number of divided subfield groups, such that each divided idle period is placed in front of a first subfield group as well as between adjacent subfield groups.

These above-mentioned variations are obvious to a person of an ordinary skill in the art referring to the detailed description provided herein.

While this invention has been described in connection with the disclosed embodiments, it is to be understood that the invention is not limited thereto but, on the contrary, is intended to cover various modifications and equivalent arrangements included within the spirit and scope of the appended claims.

What is claimed is:

1. A method for driving a plasma display panel, comprising:

generating a plurality of subfields based on an input video signal, the plurality of subfields are included in a frame;

displaying gray-scale data according to weight values assigned to the subfields; and changing a number of subfields included in the frame based on a load ratio corresponding to the input video signal, wherein the subfields included in the frame are divided into at least two subfield groups according to a predetermined weight value, and wherein an idle period is divided into at least first and second idle periods, the first idle period placed at a starting point of the frame before the first subfield group, the second idle period placed between two divided subfield groups, and the idle period being substantially a residual period of the frame excluding the subfields such that the at least first and second idle periods are not part of any subfield of the subfields included in the frame.

2. The PDP driving method of claim 1, wherein the predetermined weight value is established as a subfield weight value that may cause flicker when the number of subfields included in the frame is changed.

3. The PDP driving method of claim 2, wherein the predetermined weight value lies within a range of approximately 5% to 10% of a sum of the weight values for all the subfields included in the frame.

4. The PDP driving method of claim 3, wherein the predetermined weight value is approximately 7% of the sum of the weight values for all the subfields included in the frame.

5. The PDP driving method of claim 1, wherein a starting point of a subfield having a minimum weight value in a subfield group including subfields having weight values less than the predetermined weight value is the same as a starting point of the frame.

6. The PDP driving method of claim 1, wherein a finishing point of a subfield having a maximum weight value in a subfield group including subfields having weight values greater than or equal to the predetermined weight value is the same as a finishing point of the frame.

7. The PDP driving method of claim 1, wherein a finishing point of a subfield having a maximum weight value in a subfield group including subfields having weight values greater than or equal to the predetermined weight value is earlier than a finishing point of the frame.

8. The PDP driving method of claim 7, wherein the time between the finishing point of the subfield having the maximum weight value and the finishing point of the frame does not exceed 500 μs.

9. The PDP driving method of claim 1, wherein the subfields in the two subfield groups are arranged in an increasing order of the subfield weight values.

10. The PDP driving method of claim 1, wherein the subfields in the two subfield groups are arranged in a decreasing order of the subfield weight values.

11. The PDP driving method of claim 1, wherein the input video signal conforms with a National Television System Committee (NTSC) scheme.

12. The PDP driving method of claim 1, wherein:

the idle period is placed between two divided subfield groups when the number of subfields included in the frame is greater than or equal to a predetermined number; and the idle period is divided into the at least first and second idle periods when the number of subfields included in the frame is less than the predetermined number.

13. The PDP driving method of claim 12, wherein the predetermined number is 12.

14. The PDP driving method of claim 12, wherein the first idle period has substantially the same time length as a subfield having a minimum weight value in a first subfield group including subfields of having weight values less than the predetermined weight value.

15. The PDP driving method of claim 14, wherein the first idle period lies within a range of approximately 0 μs-1 ms.

16. The PDP driving method of claim 1, wherein the first idle period has substantially the same time length as a subfield having a minimum weight value in a first subfield group including subfields of having weight values less than the predetermined weight value.

17. The PDP driving method of claim 16, wherein the first idle period lies within a range of approximately 0 μs-1 ms.

18. A plasma display panel driving apparatus used in a plasma display panel displaying gray-scale data according to a combination of weight values assigned to subfields included in a frame, the driving apparatus comprising:

an automatic power control (APC) unit detecting a load ratio of an input video signal, the APC unit outputting an APC level for controlling power consumption based on the detected load ratio; and a sustain/scan driving controller calculating APC data including a number of subfields to be included in the frame corresponding to the APC level outputted by the APC unit, a starting point and duration of each subfield, and a number of sustain pulses, the sustain/scan driving controller generating a subfield arrangement structure according to the calculated APC data, wherein the number of subfields is divided into at least two subfields groups based on a predetermined weight value, wherein an idle period is divided into at least first and second idle periods, the first idle period is placed at a starting point of the frame, the second idle period is placed between two divided subfield groups, and the idle period being substantially a residual period of the frame excluding the subfields such that the idle period is not part of any subfield of the subfields included in the frame, wherein only the idle period or the second idle period is placed between two divided subfield groups, wherein the idle period is placed between two divided subfield groups when the number of subfields included in the frame is greater than or equal to a predetermined number, and wherein the idle period is divided into the at least first and second idle periods when the number of subfields included in the frame is less than the predetermined number.

19. The driving apparatus of claim 18, further comprising:

a memory controller for receiving the input video signal and the number of subfields calculated by the sustain/scan driving controller, and generating corresponding subfield data;

an address driver for generating address data corresponding to the subfield data output from the memory controller, the address driver applying the address data to an address electrode of the plasma display panel; and a sustain/scan driver for generating a sustain pulse and a scan pulse based on the subfield arrangement structure output from the sustain/scan driving controller, and applying the sustain and scan pulses to sustain and scan electrodes of the plasma display panel.

20. The driving apparatus of claim 18, wherein the predetermined weight value is approximately 7% of a sum of weight values for all subfields included in the frame.

21. The driving apparatus of claim 18, wherein the idle period is calculated based on the APC data comprising the number of subfields calculated by the sustain/scan driving controller and the starting point and the duration of each subfield.

22. The PDP driving apparatus of claim 18, wherein the first idle period has the same time length as the subfield having a minimum weight value in a first subfield group including subfields having weight values less than the predetermined weight value.

* * * * *